US008177036B2

(12) United States Patent
Stanley et al.

(10) Patent No.: US 8,177,036 B2
(45) Date of Patent: May 15, 2012

(54) COMMUNICATION OF ELEVATOR REASSIGNMENT INFORMATION IN A GROUP ELEVATOR SYSTEM

(75) Inventors: Jannah Stanley, Cormwell, CT (US); Paul A. Stranieri, Bristol, CT (US); Richard K Pulling, Jr., Avon, CT (US); Vlad Zaharia, Rocky Hill, CT (US); Daniel Williams, Southington, CT (US); Richard Mangini, Brookfield, CT (US); Wade Montague, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 620 days.

(21) Appl. No.: 11/988,787

(22) PCT Filed: Jul. 18, 2005

(86) PCT No.: PCT/US2005/025272

§ 371 (c)(1),
(2), (4) Date: Jul. 2, 2009

(87) PCT Pub. No.: WO2007/011346

PCT Pub. Date: Jan. 25, 2007

(65) Prior Publication Data

US 2009/0301820 A1 Dec. 10, 2009

(51) Int. Cl.
*B66B 1/34* (2006.01)

(52) U.S. Cl. ..... 187/396; 187/382

(58) Field of Classification Search ..... 187/247, 187/380–389, 391–396

See application file for complete search history.

(56) References Cited

U.S. PATENT DOCUMENTS

| | | | | |
|---|---|---|---|---|
| 4,852,696 | A | 8/1989 | Fukuda et al. | |
| 5,398,783 | A * | 3/1995 | Jacoby | 187/395 |
| 5,551,532 | A | 9/1996 | Kupersmith | |
| 5,551,533 | A | 9/1996 | Ng | |
| 6,065,570 | A | 5/2000 | Friedli et al. | |
| 6,315,083 | B1 | 11/2001 | Schuster et al. | |
| 6,360,849 | B1 * | 3/2002 | Hikita | 187/381 |
| 6,976,560 | B2 * | 12/2005 | Newby | 187/383 |
| 7,040,458 | B2 | 5/2006 | Forsythe et al. | |
| 7,610,995 | B2 * | 11/2009 | Ylinen et al. | 187/382 |

(Continued)

FOREIGN PATENT DOCUMENTS

CH 2002-24-9289 A 2/2001

(Continued)

OTHER PUBLICATIONS

Chinese Office Action for PCT/US2005/025272, mailed Sep. 4, 2009.

(Continued)

*Primary Examiner* — Anthony Salata
(74) *Attorney, Agent, or Firm* — Kinney & Lange, P.A.

(57) ABSTRACT

Elevator reassignment information is communicated to passengers in a group elevator system (10). The group elevator system (10) includes a group of elevators (14*a*, 14*b*, 14*c*) that is operable to transport each of the passengers to one of a plurality of floors (L, F2, F3, F4, F5). A destination entry input device (30, 35) at each floor permits each passenger to enter destination input information. A dispatch controller (20) assigns an elevator to each passenger based on the destination input information. When service of a dispatched elevator is terminated, a communication device (46, 50) communicates elevator reassignment instructions to passengers assigned to or located in the dispatched elevator.

18 Claims, 3 Drawing Sheets

U.S. PATENT DOCUMENTS

| | | | | |
|---|---|---|---|---|
| 7,650,967 | B2 * | 1/2010 | SikShin et al. | 187/249 |
| 7,975,808 | B2 * | 7/2011 | Smith et al. | 187/382 |
| 7,987,947 | B2 * | 8/2011 | Christy et al. | 187/249 |
| 2004/0262093 | A1 | 12/2004 | Forsyeth et al. | |

FOREIGN PATENT DOCUMENTS

| | | | |
|---|---|---|---|
| JP | 1167192 | A | 6/1989 |
| JP | 3279172 | A | 12/1991 |
| JP | 8208148 | A | 8/1996 |
| JP | 2000118896 | A | 4/2000 |
| JP | 2001287876 | A | 10/2001 |
| JP | 2003012249 | A | 1/2003 |
| JP | 2004107046 | A | 4/2004 |
| JP | 2005170528 | A | 6/2005 |
| KR | 1019910015488 | | 9/1991 |
| WO | WO2005019084 | A1 | 3/2005 |

OTHER PUBLICATIONS

European Search Report, mailed Mar. 15, 2011.
PCT International Search Report and Written Opinion, Mar. 2, 2007, 6 pages.
Translation of Japanese Office Action, mailed Jul. 26, 2011.
Korean Office Action, mailed Oct. 26, 2011.

* cited by examiner

COMMUNICATION OF ELEVATOR REASSIGNMENT INFORMATION IN A GROUP ELEVATOR SYSTEM

BACKGROUND OF THE INVENTION

The present invention relates to the field of elevator control, and in particular to the communication of elevator reassignment information in a group elevator system.

Conventional group elevator systems include up and down buttons near the elevators for use by passengers when elevator service is desired. When one of these hall call buttons is pressed, an elevator that will most efficiently deliver the passengers in the desired direction is assigned. When the assigned elevator arrives at the floor on which the call occurred, a hall lantern above the assigned elevator illuminates to designate the elevator the passengers should enter. If the assigned elevator becomes unable to serve the passengers or is significantly delayed, the passengers must be assigned to a new elevator. This is accomplished by turning off the hall lantern above the originally assigned elevator, and illuminating the hall lantern above the newly assigned elevator when it arrives at the floor on which the call occurred. In addition, if a passenger is in an elevator when service of the elevator is terminated or when all floor requests have been fulfilled, the passenger may press a button on the car operating panel (COP) in the elevator to enter his or her floor request, or to exit the elevator and subsequently make a new hall call for a different elevator. While this is an effective system for reassigning passengers, these conventional systems suffer from the drawback of being unable to direct individual passengers requesting elevator service from the same floor in the same direction to different elevators.

Recently, elevator systems with destination entry have been introduced. In a destination entry system, passengers are required to register their destination floors before they are picked up. The group elevator system assigns each passenger to an elevator that most efficiently transports him or her to the desired destination floor. Passengers register their destination floors on destination entry devices, which are mounted near the elevators and can take the form of a numeric keypad or a touch screen display. The destination entry devices often include audio and visual capabilities, for example to verify a passenger's destination floor entry and to assist passengers with disabilities. However, because passengers enter their respective destination floors in short succession and are immediately assigned to different elevators, these systems do not include hall lanterns. Thus, passengers assigned to an elevator when its service is terminated must be alerted to the elevator assignment change. Also, in some destination entry systems, the COP in the elevator is either not accessible or non-functional. As a result, passengers in an elevator when service is terminated must be instructed as to how to get out of the elevator and to their desired destination.

BRIEF SUMMARY OF THE INVENTION

The subject invention is directed to communicating elevator reassignment information to passengers in a group elevator system. The group elevator system includes multiple elevators operable to transport each of the passengers to one of a plurality of floors. A destination entry input device at each floor permits each passenger to enter destination input information. A dispatch controller assigns an elevator to each passenger based on the destination input information. When service of a dispatched elevator is terminated, a communication device communicates elevator reassignment instructions to passengers assigned to or located in the dispatched elevator.

DETAILED DESCRIPTION

Figure 1:
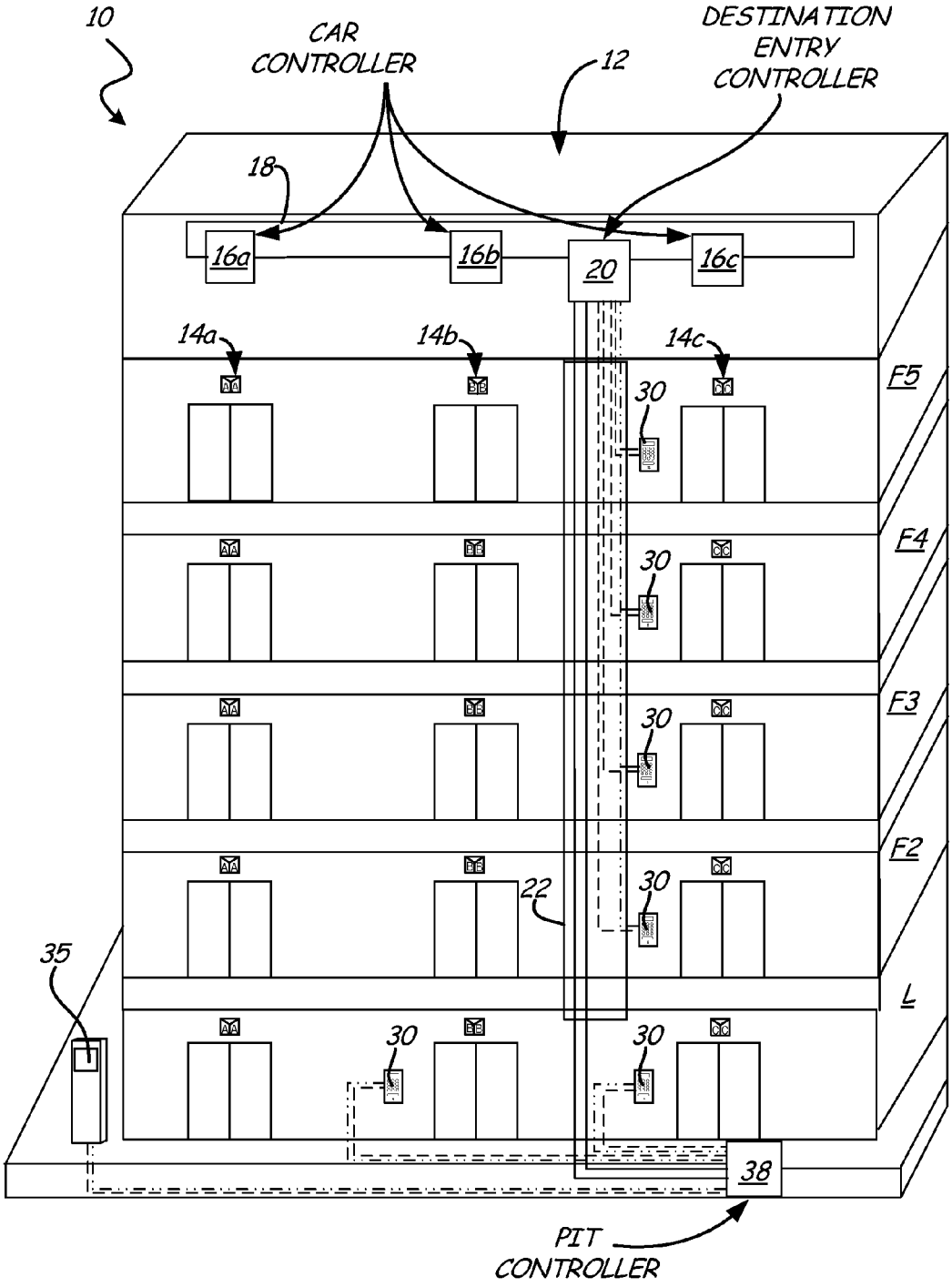
FIG. 1 is a perspective view of a destination entry group elevator system.

FIG. 1 is a perspective view of destination entry based elevator system 10 in building 12. Building 12 includes five floors, including lobby floor L, second floor F2, third floor F3, fourth floor F4, and fifth floor F5. Group elevator system 10 includes three elevators 14*a*, 14*b*, and 14*c*, each of which is operable to transport passengers to any of the floors in building 12. While three elevators 14*a*-14*c* and five floors L and F2-F5 are shown, it will be appreciated that the present invention is applicable to destination entry group elevator systems with any number of elevators servicing any number of floors.

The operation of each elevator is controlled by a dedicated car controller. In particular, elevator 14*a* is controlled by car controller 16*a*, elevator 14*b* is controlled by car controller 16*b*, and elevator 14*c* is controlled by car controller 16*c*. Car controllers 16*a*-16*c* are connected to and communicate with each other via communications loop 18.

Car controllers 16*a*-16*c* control elevators 14*a*-14*c*, respectively, based on elevator control information received from destination entry controller (DEC) 20. DEC 20 is connected to car controllers 16*a*-16*c* via communications loop 18. DEC 20 processes destination input information received via communications lines 22 and provides elevator control information based on the destination input information.

Destination input information is provided by passengers via destination entry input devices located on each floor. The destination entry input devices are located next to the elevators on each floor and are used by passengers to enter their desired destination floor via numbered keys on the input device. The destination entry input devices may also include keys labeled for specific areas of the building such that a passenger may press the labeled keys to be transported directly to the area on the key. In group elevator system 10, the destination entry input devices include keypads 30 and touch screen display 35. Keypads 30 will be described in more detail with regard to FIG. 2, and touch screen display 35 will be described in more detail with regard to FIG. 3. Each keypad 30 on floors F2-F5 is connected directly to DEC 20 via a data line (e.g., Ethernet) and a common ground line. Keypads 30 and touch screen display 35 on lobby floor L are connected to DEC 20 via pit controller 38. It will be appreciated that any combination of keypads 30 and touch screen displays 35 may be employed throughout building 12. Alternatively, keypads 30 on floors L-F5 may be replaced by conventional up and down hall call buttons.

The scheduling of elevators 14*a*-14*c* is coordinated by DEC 20 based on the destination input information provided on keypads 30 and touch screen display 35. Elevators 14*a*-14*c* are independent, but are coupled through serving a common pool of passengers. For each passenger, there is only one elevator 14 that will serve that passenger. As each passenger enters his or her destination floor on one of keypads 30 or touch screen display 35, the passenger is directed to an elevator that will most efficiently service his or her destination request. DEC 20 groups passengers who are going to common or nearby floors to the same elevator 14. DEC 20 communicates with car controllers 16*a*-16*c* to determine the locations of elevators 14*a*-14*c* when assigning passengers to an elevator. When passengers enter their assigned elevator, the car controller controls the elevator so as to stop only at those floors that passengers on the assigned elevator requested. By grouping passengers in this way, passengers reach their destination floor in an efficient manner with fewer stops than in conventional elevator systems.

Figure 2:
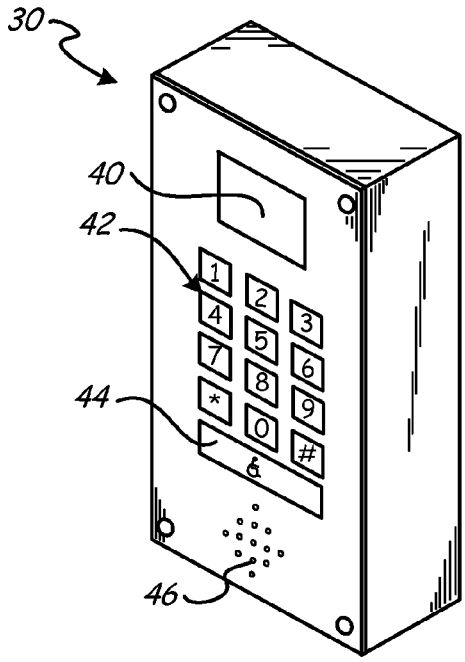
FIG. 2 is a perspective view of a keypad used in the destination entry group elevator system shown in FIG. 1.

FIG. 2 is a perspective view of keypad 30 used in the destination entry group elevator system 10 shown in FIG. 1. Keypad 30 includes display 40, numeric keys 42, accessibility key 44, and electroacoustic transducer or speaker 46. In one embodiment, display 40 is a liquid crystal display (LCD) or light-emitting diode (LED) type display.

When a passenger wishes to be transported between floors in group elevator system 10, the passenger enters his or her desired destination floor using numeric keys 42. For example, if a passenger wants to be transported from lobby floor L to floor F4, the passenger presses the "4" key on numeric keys 42 of one of keypads 30 located on lobby floor L. This destination input information is then provided to DEC 20. Based on the locations of the cars in elevators 14*a*-14*c* (as provided by car controllers 16*a*-16*c*), DEC 20 provides a signal to keypad 30 that was used by the passenger to enter the destination input information. This signal contains the passenger's elevator assignment. Keypad 30 then directs the passenger to the appropriate elevator using display 40. For example, if the passenger uses keypad 30 nearest elevator 14*c* to enter the destination input information, and the passenger is assigned to elevator 14*a* by DEC 20, the letter "A" appears on display 40. An arrow or other directing symbol may also be displayed on display 40 to guide the passenger in the direction of the assigned elevator.

Keypad 30 also includes accessibility key 44 for use by disabled passengers to initiate service in group elevator system 10. When a passenger presses accessibility key 44, auditory instructions regarding use of keypad 30 are provided on speaker 46. For example, the passenger may be directed to use numeric keys 42 to enter his or her desired destination floor. After the passenger enters his or her desired destination floor, the passenger is given auditory directions via speaker 46 regarding which elevator is assigned to the passenger and how to reach the assigned elevator. The assigned elevator may also be simultaneously displayed on display 40 as described above.

Figure 3:
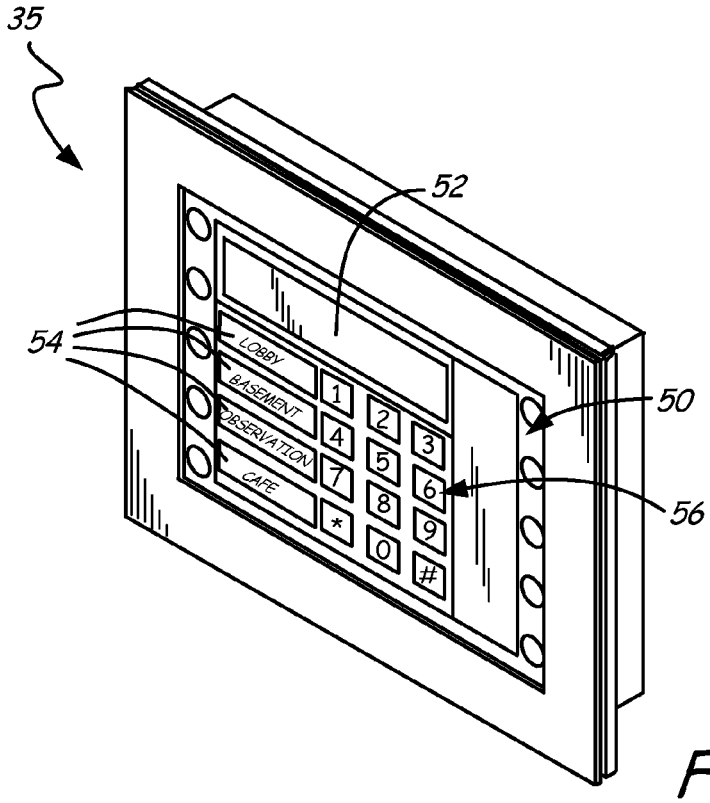
FIG. 3 is a perspective view of a touch screen display used in the destination entry group elevator system shown in FIG. 1.

FIG. 3 is a perspective view of a touch screen display 35 used in the destination entry group elevator system 10 shown in FIG. 1. Touch screen display 35 includes screen 50 for displaying various interactive buttons for use by passengers to operate group elevator system 10. The information provided on screen 50 is customizable to the building in which it is provided. In the embodiment shown, screen 50 includes active display 52, location specific buttons 54, and numeric keys 56.

When a passenger wishes to be transported between floors in group elevator system 10, the passenger enters his or her desired destination floor using numeric keys 56. For example, if a passenger wants to be transported from lobby floor L to floor F4, the passenger presses the "4" key on numeric keys 56 of touch screen 35 located on lobby floor L. This destination input information is then provided to DEC 20. Based on the locations of the cars in elevators 14*a*-14*c* (as provided by car controllers 16*a*-16*c*), DEC 20 provides a signal to touch screen 35. This signal contains the passenger's elevator assignment. Touch screen 35 then directs the passenger to the appropriate elevator using active display 52. For example, if the passenger is assigned to elevator 14*a* by DEC 20, the letter "A" appears on active display 52. An arrow or other directing symbol may also be displayed on active display 52 to guide the passenger in the direction of the assigned elevator.

Additionally, screen 50 includes location-specific buttons 54. These buttons are optionally provided on screen 50 to allow passengers to select their destination based on a particular location or featured area of the building. For example, in a system including a touch screen display 35 on each floor, a passenger on floor F3 desiring to go to lobby level L could press the button labeled "LOBBY" on screen 50 (instead of pressing the "1" key for the first level). The passenger would then be directed via active display 52 to the elevator that will most efficiently transport him or her to lobby level L.

When passengers enter their respective desired destination floors on a destination entry input device (i.e., keypad 30 and touch screen 35), they are assigned an elevator by DEC 20 to bring them to their desired destinations. However, if an elevator that has been assigned and dispatched becomes delayed or service of the elevator is terminated, the passengers assigned to the dispatched elevator are assigned to a new elevator capable of servicing their request. In addition, if an elevator parks or service of the elevator is terminated (e.g., due to mechanical or electrical failure), it is determined whether passengers remain in the parked elevator. Passengers remaining in the terminated elevator are provided with instructions for how to exit the terminated elevator and be reassigned to a new elevator.

Figure 4:
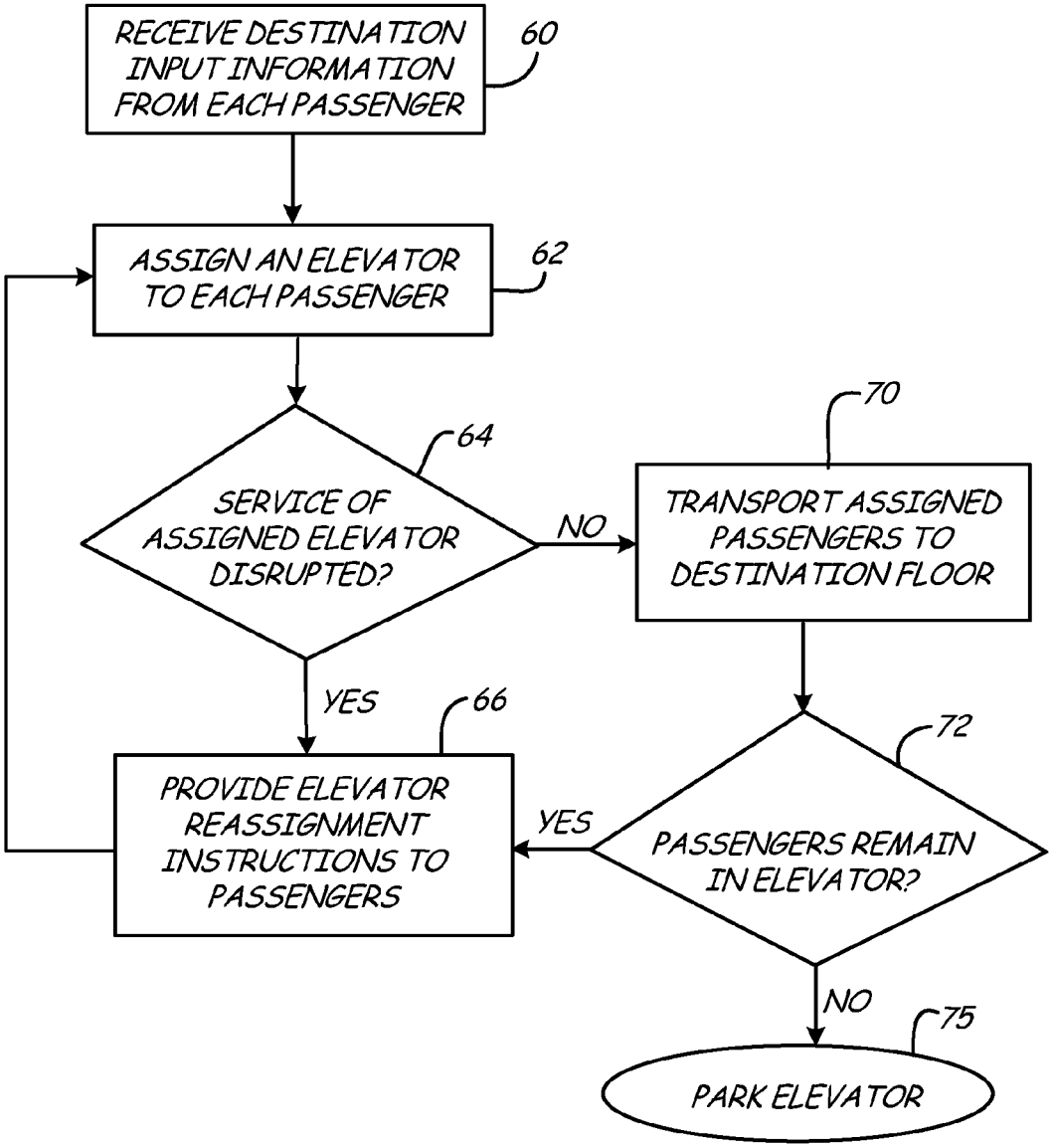
FIG. 4 is a flow chart for the process of communicating elevator reassignment instructions to passengers according to the present invention.

FIG. 4 is a flow chart for the process of communicating elevator reassignment instructions to passengers in group elevator system 10 according to the present invention. To initiate elevator service, group elevator system 10 receives destination input information from each passenger (step 60). As described above, each passenger enters his or her destination floor on destination entry input devices, such as keypads 30 or touch screen 35, located near the elevators.

As each passenger enters his or her destination input information on the destination entry input devices, each passenger is assigned to an elevator (step 62). As described above, DEC 20 assigns groups of passengers who are going to common or nearby floors to the same elevator 14.

If service of an elevator assigned to a passenger or group of passengers is disrupted due to a significant delay or termination of service of the assigned elevator (decision step 64), elevator reassignment instructions are provided to the passenger or group of passengers assigned to the elevator (step 66). This information is communicated to the passengers in auditory format via speaker 46 on keypads 30. For example, vocal instructions may be provided via speaker 46 of keypad 30 nearest the originally assigned elevator for directing the passengers to a new elevator capable of servicing their request. Alternatively, each passenger may be requested via auditory instructions on speaker 46 of keypad 30 nearest the originally assigned elevator to reenter his or her destination floor on any destination entry input device (i.e., any of keypads 30 or touch screen display 35). In addition, touch screen display 35 may be used to visually communicate elevator reassignment information to the passengers. DEC 20 then assigns each passenger to a new elevator based on the entered destination input information (step 62).

If service of the elevator assigned to a passenger or group of passengers is not disrupted (decision step 64), the elevator transports the passengers assigned to the elevator to their respective destination floors (step 70). When the elevator has fulfilled the destination requests of all assigned passengers, it is then determined whether any passengers remain in the elevator (decision step 72). This may be determined in a variety of ways, including through the use of motion sensors or cameras installed in each elevator 14*a*-14*c*, by determining whether the elevator's weight after all destination requests have been fulfilled is greater than the elevator's empty weight, or through the use of load cells, strain gauges, or similar devices located under the elevator floor to determine passenger weight. In one embodiment, the elevator provides a signal to DEC 20 indicating whether passengers remain in the elevator. If it is determined that no passengers remain in the elevator, the elevator is parked until DEC 20 commands the elevator (via its dedicated car controller) to pick up a new passenger or group of passengers (step 75).

If it is determined that a passenger or passengers remain in the elevator after fulfilling all destination requests (decision step 72), the passengers are provided with elevator reassignment instructions (step 66). Passengers may remain on an elevator after all requests have been fulfilled for a variety of reasons. For example, a passenger may have entered an open elevator without entering his or her destination input information, or the passenger may have entered the wrong elevator after being assigned to an elevator. In any case, a passenger who remains in the elevator is first given instructions as to how to exit the elevator. This information may be provided via auditory instructions over a speaker inside the elevator car. For example, if elevators 14*a*-14*c* include a car operating panel (COP) inside the elevator car, the passenger may be audibly instructed to press the button corresponding to his or her desired destination floor on the COP.

If elevators 14*a*-14*c* do not include a car operating panel (COP) inside the elevator car, the passenger may be provided auditory instructions to press a "Door Open" button in the elevator and subsequently exit the elevator. This may also be accompanied by a visual indicator to indicate which button the passenger should press, such as by flashing a tell tale light surrounding the Door Open button. Alternatively, when it is determined that a passenger remains in an elevator without a COP, the elevator doors may open automatically to allow the passenger to exit the elevator. When the passenger has exited the elevator, he or she may be audibly instructed via speaker 46 of keypad 30 nearest the elevator to enter his or her destination input information on a destination entry input device. The passenger is subsequently assigned to a new elevator that will fulfill his or her request (step 62).

In summary, because destination entry group elevator systems typically do not include hall lanterns to indicate an elevator assignment change due to termination of service, passengers assigned to an elevator when its service is terminated must be alerted to the elevator assignment change. Also, when the car operating panel in the elevator is either not accessible or non-functional, a passenger in the elevator must be instructed as to how to get out of the elevator and to their desired destination. The present invention is directed to communicating elevator reassignment information to passengers in a group elevator system. The group elevator system includes a group of elevators that is operable to transport each of the passengers to one of a plurality of floors. A destination entry input device at each floor permits each passenger to enter destination input information. A dispatch controller assigns an elevator to each passenger based on the destination input information. When service of a dispatched elevator is terminated, a communication device communicates elevator reassignment instructions to passengers assigned to or located in the dispatched elevator.

Although the present invention has been described with reference to examples and preferred embodiments, workers skilled in the art will recognize that changes may be made in form and detail without departing from the spirit and scope of the invention.

The invention claimed is:

1. A system comprising:

a group of elevators operable to transport each of a plurality of passengers to one of a plurality of floors;

a destination entry input device at each floor for permitting each passenger to enter destination input information;

a dispatch controller for assigning an elevator to each passenger based on the destination input information;

a sensing device for determining whether passengers remain in the dispatched elevator after service of the dispatched elevator is terminated; and a communication device for communicating elevator reassignment instructions to passengers assigned to or located in a dispatched elevator when service of the dispatched elevator is terminated.

2. The system of claim 1, wherein the destination entry input device comprises a keypad.

3. The system of claim 1, wherein the destination entry input device comprises a touch screen display.

4. The system of claim 1, wherein the communication device comprises an electroacoustic transducer.

5. The system of claim 1, wherein the communication device comprises an electronic display.

6. The system of claim 1, wherein the reassignment instructions are communicated to floors on which a passenger provided destination input information on the destination entry input device.

7. The system of claim 1, wherein the sensing device comprises a motion detector.

8. A method for communicating with passengers in a group elevator system, the method comprising:

receiving destination input information from each passenger on a destination entry input device;

assigning an elevator to each passenger based on the destination input information;

determining whether passengers remain in the dispatched elevator after service of the dispatched elevator is terminated; and providing elevator reassignment instructions to passengers assigned to a dispatched elevator or passengers not assigned to, but located in, the dispatched elevator when service of the dispatched elevator is terminated.

9. The method of claim 8, wherein providing elevator reassignment instructions to passengers comprises audibly communicating the elevator reassignment instructions to the passengers.

10. The method of claim 8, wherein providing elevator reassignment instructions to passengers comprises visually communicating the elevator reassignment instructions to the passengers.

11. The method of claim 8, wherein providing elevator reassignment instructions to passengers comprises:

instructing each passenger to reenter their destination input information on a nearest destination entry input device; and reassigning each passenger to a new elevator based on their destination input information.

12. The method of claim 8, and further comprising:

providing passengers who remain in the dispatched elevator with instructions regarding exiting the dispatched elevator.

13. A method for controlling elevator assignment in a destination entry group elevator system, the method comprising:

receiving destination input information from each passenger on a destination entry input device;

assigning an elevator to each passenger based on the destination input information;

determining when service of a dispatched elevator is terminated;

determining whether passengers remain in the dispatched elevator after service of the dispatched elevator is terminated;

instructing each passenger assigned to the dispatched elevator to reenter destination input information on a destination entry input device; and reassigning each passenger to a new elevator based on the reentered destination input information.

14. The method of claim 13, wherein providing elevator reassignment instructions to passengers comprises audibly communicating the elevator reassignment instructions to the passengers.

15. The method of claim 13, wherein providing elevator reassignment instructions to passengers comprises visually communicating the elevator reassignment instructions to the passengers.

16. The method of claim 13, and further comprising:

providing passengers who remain in the dispatched elevator with instructions regarding exiting the dispatched elevator.

17. A system comprising:

a group of elevators operable to transport each of a plurality of passengers to one of a plurality of floors;

a destination entry input device at each floor for permitting each passenger to enter destination input information;

a dispatch controller for assigning an elevator to each passenger based on the destination input information;

a communication device for communicating elevator reassignment instructions to passengers assigned to or located in a dispatched elevator when service of the dispatched elevator is terminated; and a sensing device for determining whether passengers remain in the dispatched elevator after service of the dispatched elevator is terminated.

18. A method for communicating with passengers in a group elevator system, the method comprising:

receiving destination input information from each passenger on a destination entry input device;

assigning an elevator to each passenger based on the destination input information; and providing elevator reassignment instructions to passengers assigned to a dispatched elevator or passengers not assigned to, but located in, the dispatched elevator when service of the dispatched elevator is terminated, wherein the elevator reassignment instructions are provided by instructing each passenger to reenter their destination input information on a nearest destination entry input device and reassigning each passenger to a new elevator based on their destination input information.

* * * * *

UNITED STATES PATENT AND TRADEMARK OFFICE

CERTIFICATE OF CORRECTION

PATENT NO. : 8,177,036 B2
APPLICATION NO. : 11/988787
DATED : May 15, 2012
INVENTOR(S) : Jannah Stanley et al.

It is certified that error appears in the above-identified patent and that said Letters Patent is hereby corrected as shown below:

Title Page, Item (75)
First Inventor Jannah Stanley's residence
Delete "Cormwell"
Insert --Cromwell--

Signed and Sealed this
Fourteenth Day of August, 2012

David J. Kappos

David J. Kappos
*Director of the United States Patent and Trademark Office*